US009568183B2

(12) United States Patent
Voskanian

(10) Patent No.: US 9,568,183 B2
(45) Date of Patent: Feb. 14, 2017

(54) LIGHTED BACKPACK

(71) Applicant: Richard Voskanian, Moorpark, CA (US)

(72) Inventor: Richard Voskanian, Moorpark, CA (US)

( * ) Notice: Subject to any disclaimer, the term of this patent is extended or adjusted under 35 U.S.C. 154(b) by 31 days.

(21) Appl. No.: 14/860,195

(22) Filed: Sep. 21, 2015

(65) Prior Publication Data

US 2016/0084492 A1 Mar. 24, 2016

Related U.S. Application Data

(60) Provisional application No. 62/053,345, filed on Sep. 22, 2014.

(51) Int. Cl.

| | |
|---|---|
| ***F21V 33/00*** | (2006.01) |
| ***F21V 23/04*** | (2006.01) |
| ***A45C 15/06*** | (2006.01) |
| ***A45F 3/04*** | (2006.01) |
| *F21Y 101/00* | (2016.01) |

(52) U.S. Cl.

CPC ..... *F21V 33/0004* (2013.01); *A45C 15/06* (2013.01); *A45F 3/04* (2013.01); *F21V 23/0471* (2013.01); *F21Y 2101/00* (2013.01); *F21Y 2113/17* (2016.08); *F21Y 2115/10* (2016.08)

(58) Field of Classification Search

CPC .. F21V 33/0004; F21V 23/0471; A45C 15/06; A45F 3/04

See application file for complete search history.

(56) References Cited

U.S. PATENT DOCUMENTS

| | | | | |
|---|---|---|---|---|
| 3,609,342 | A | 9/1971 | Wisniewski | |
| 3,792,652 | A | 2/1974 | Zeeb | |
| 3,800,134 | A | 3/1974 | Castaldo | |
| 5,908,232 | A | 6/1999 | Burns et al. | |
| 6,447,142 | B1 | 9/2002 | Weir | |
| 8,282,235 | B2 | 10/2012 | Gilligan | |
| 9,064,433 | B2 * | 6/2015 | Jumblatt | B65D 1/02 |
| 2007/0159808 | A1 * | 7/2007 | Chen | A45F 3/04 362/103 |
| 2016/0157575 | A1 * | 6/2016 | Britten | A45C 15/06 362/156 |

* cited by examiner

*Primary Examiner* — David V Bruce

(74) *Attorney, Agent, or Firm* — Global Intellectual Property Agency, LLC; Daniel Boudwin

(57) ABSTRACT

A lighted backpack having interior light for illuminating the contents of the backpack. The lighted backpack includes a housing having an opening that provides access to an interior volume therein, wherein a fastener is configured to removably fasten the opening and the interior volume. The interior volume includes a lighting assembly having a power supply, a sensor, a control switch, a microprocessor, and at least one light emitting diode (LED). The LED includes at least three different colored diodes that are varied in relative intensity to one another to achieve a multitude of colors. The control switch allows a user to select a desired resultant color, which is relayed to the microprocessor to modulate the relative intensity of the different colored diodes to achieve the desired resultant color. The sensor is configured to activate the lighting assembly when a user reaches within the interior volume of the housing.

8 Claims, 3 Drawing Sheets

LIGHTED BACKPACK

CROSS REFERENCE TO RELATED APPLICATION

This application claims the benefit of U.S. Provisional Application No. 62/053,345 filed on Sep. 22, 2014. The above identified patent application is herein incorporated by reference in its entirety to provide continuity of disclosure.

BACKGROUND OF THE INVENTION

Field of the Invention

The present invention relates to a backpack. More specifically, the present invention pertains to an improved backpack that includes a lighting assembly that aids in searching for items stored within the interior volume of the backpack by providing illumination.

Backpacks are generally bags with shoulder straps that allow the bag to be carried on one's back. They are often used to travel or hike while carrying one's belongings therein. Most often, backpacks are used by hikers and students, however, backpacks can also be used for a variety of other purposes, wherein carrying loads, such as books and equipment are needed. For example, users that go backpacking, which involves placing substantially all items needed for travel in a backpack that is easily carried for long distances or long periods of time.

These excursions usually extend for a period time, and require many different items that allow a backpacker to adapt to a variety of situations. These items include jeans, flip flops, shoes, dress shirts, socks, hats, jackets, hats, toiletries and many more. However, because so many items are stuffed within the interior volume of the backpack, it often is very difficult to find items within the interior volume simply by feeling around for the item. Therefore, there exists a need for backpack that includes a lighting assembly that illuminates the interior volume of the backpack to aid a user in searching for items stored therein.

The present invention provides a lighted backpack that includes a housing having an opening that provides access to an interior volume. The opening includes a fastener that removably fastens the opening and the interior volume to prevent items stored therein from falling out. The interior volume includes a light assembly therein configured to provide illumination within the interior volume of the housing. The lighting assembly includes a power supply, a sensor, a control switch, a microprocessor, and at least one light emitting diode (LED). The sensor is configured to detect a user reaching within the interior volume of the housing to find items and automatically activates the LED to provide illumination. The LED includes at least three different colored diodes within the casing, wherein the relative intensity of each different colored diode allows the LED to achieve a multitude of colors. The control switch allows the user to control the desired resultant color, which is relayed to the microprocessor that is configured to modulate and vary the relative intensity between the different colored diodes to achieve the desired resultant color.

SUMMARY OF THE INVENTION

In view of the foregoing disadvantages inherent in the known types of lighted backpacks now present in the prior art, the present invention provides a new and improved lighted backpack wherein the same can be utilized for illuminating the interior volume of a backpack to allow the user to more easily view the contents of the backpack.

It is therefore an object of the invention to provide a new and improved lighted backpack that has all of the advantages of the prior art and none of the disadvantages.

Another object of the present invention is to provide a new and improved lighted backpack that includes a housing having an interior volume, wherein an opening provides access to the interior volume.

Yet another object of the present invention is to provide a new and improved lighted backpack that includes a lighting assembly disposed within the interior volume of the housing.

Still yet another object of the present invention is to provide a new and improved lighted backpack, wherein the lighting assembly includes a power supply, a motion sensor, a control switch, a microprocessor, and at least one light emitting diode (LED).

A further object of the present invention is to provide a new and improved lighted backpack, wherein the at least one LED includes at least three different colored diodes, wherein the relative intensity of the different colored diodes of the LED are controlled by the microprocessor to achieve a desired resultant color.

Yet a further object of the present invention is to provide a new and improved lighted backpack, wherein the control switch allows a user to select a desired resultant color that is relayed to the microprocessor.

An additional object of the present invention is to provide a new and improved lighted backpack, wherein the motion sensor detects the user reaching into the interior volume of the housing, and activates the lighting assembly.

Still yet another object of the present invention is to provide a new and improved lighted backpack wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein the numeral annotations are provided throughout.

DETAILED DESCRIPTION OF THE INVENTION

Figure 1:
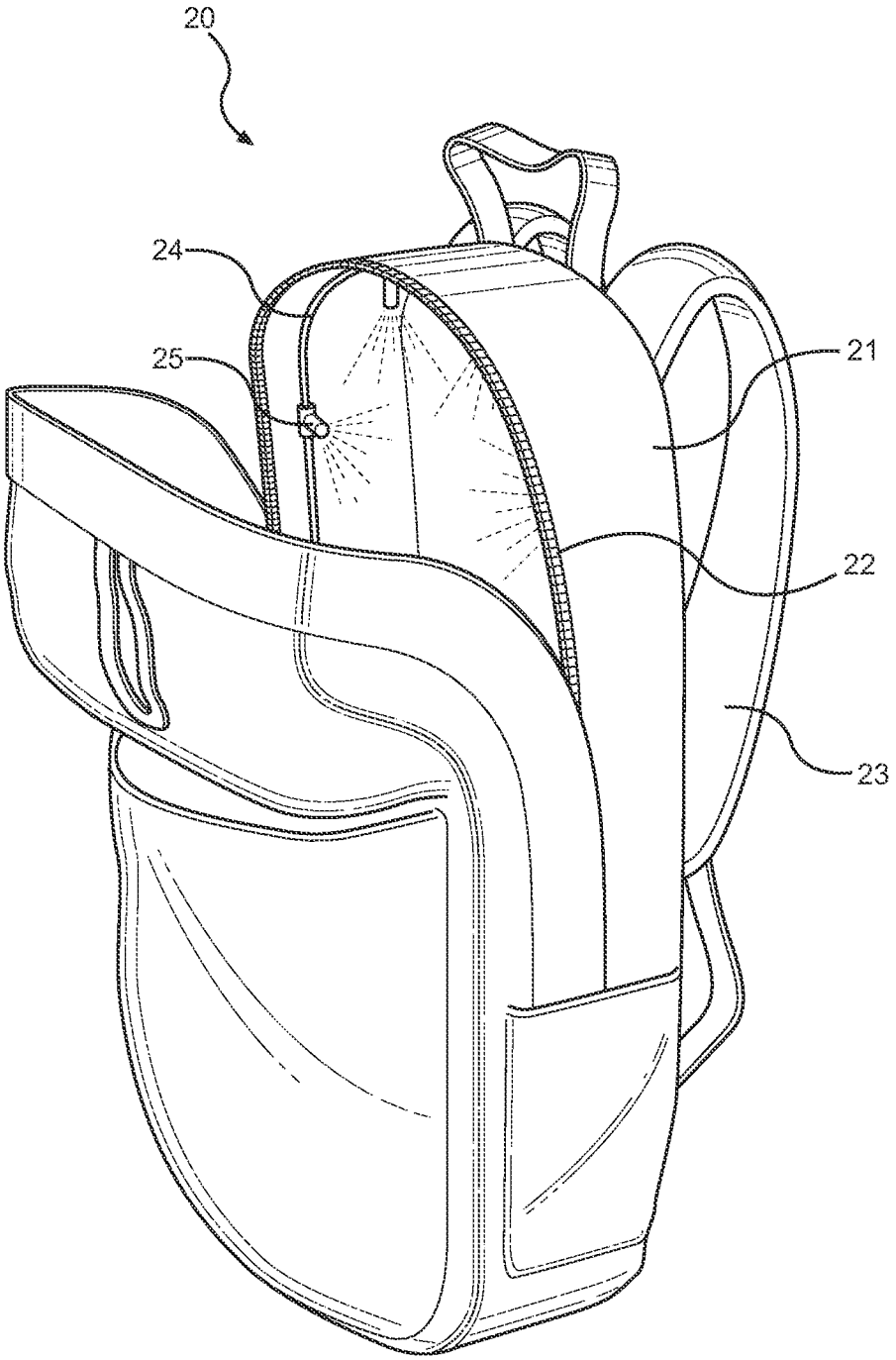
FIG. 1 shows side perspective of the lighted backpack.

References are made herein to the attached drawings. Like reference numerals are used throughout the drawings to depict like or similar elements of the lighted backpack. For the purposes of presenting a brief and clear description of the present invention, the preferred embodiment will be discussed as used to illuminate the interior volume of a backpack. The figures are intended for representative purposes only and should not be considered to be limiting in any respect.

Figure 2:
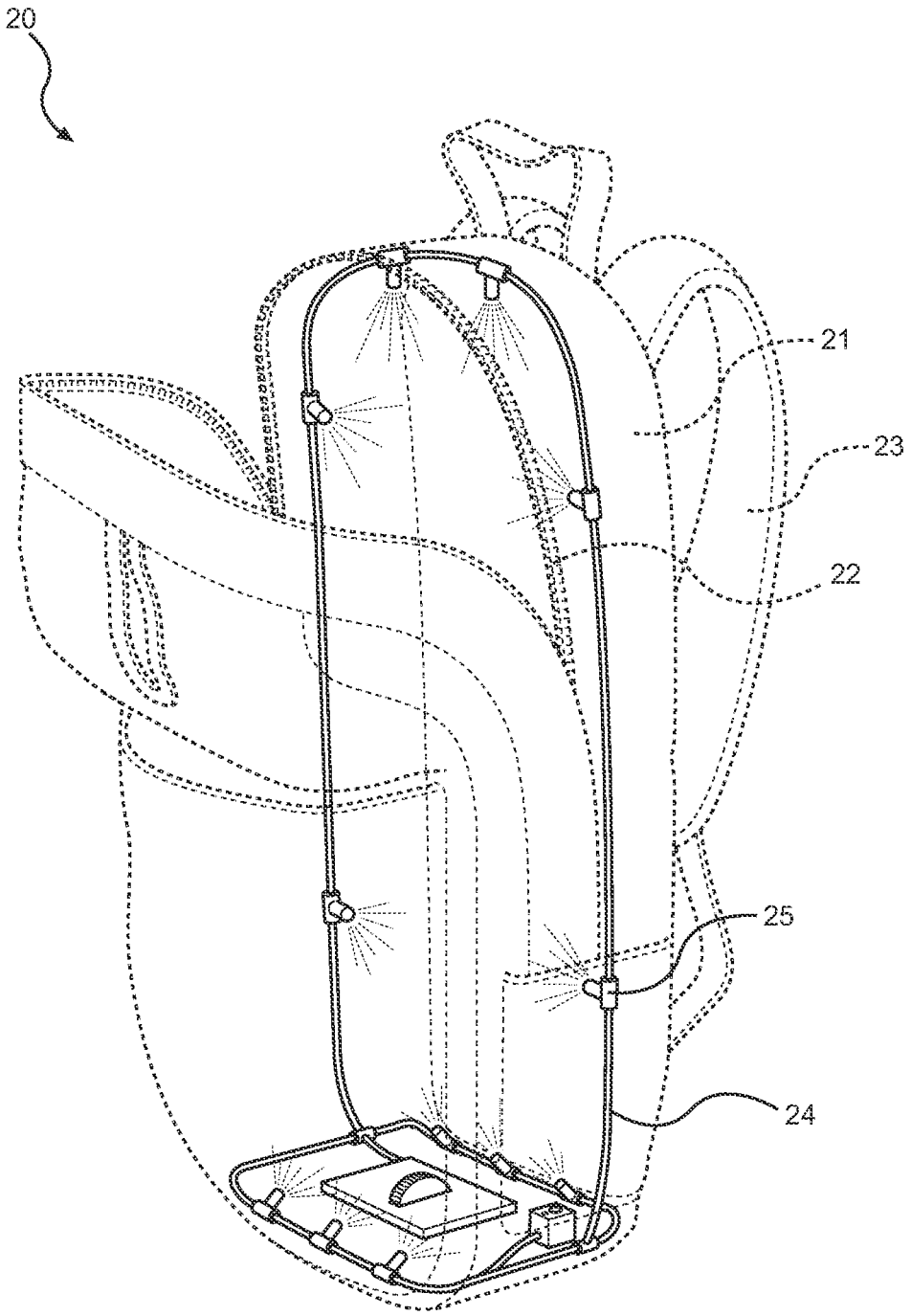
FIG. 2 shows a transparent view of the lighted backpack.

Referring now to FIGS. 1 and 2, there are shown a side perspective view and a transparent view of the lighted backpack, respectively. The backpack 20 comprises a housing 21 forming an interior volume therein. The housing 21 includes an opening that provides access to the interior volume, wherein the opening includes a fastener 22 that selectively opens and closes access to the interior volume. Preferably, the fastener 22 is a zip fastener, however, other suitable types of fasteners are contemplated. Preferably the housing 21 is substantially rectangular in shape with a central apex, however, it is contemplated that the shape of the housing 21 includes a variety of other shapes and forms. The housing 21 further includes at least one strap 23 attached thereon configured to be wrapped around a user's shoulder to support the backpack 20. It is likewise contemplated that the straps 23 can include a variety of other suitable types of straps such as long shoulder straps or cross body straps. Alternative embodiments also may include a second shoulder strap 23 that allows a user to wear the backpack 20 around both shoulders.

The housing 21 further includes a lighting assembly 24 positioned within the interior volume of the housing 21, wherein the lighting assembly 24 provides illumination within the interior volume in order to allow a user to more easily view the contents of the backpack in low-light conditions. In this way, the user can more easily see and find items stored within the interior volume, instead of merely sensing and feeling for them. Preferably, the lighting assembly 24 uses at least one light emitting diode (LED) 25, however other fluorescent lighting systems are contemplated. The LEDs 25 can be situated around the perimeter or any location within the interior volume of the interior volume in order to provide sufficient illumination therein. In some embodiments, the LEDs 25 are also affixed on an exterior surface of the housing 21.

Figure 3:
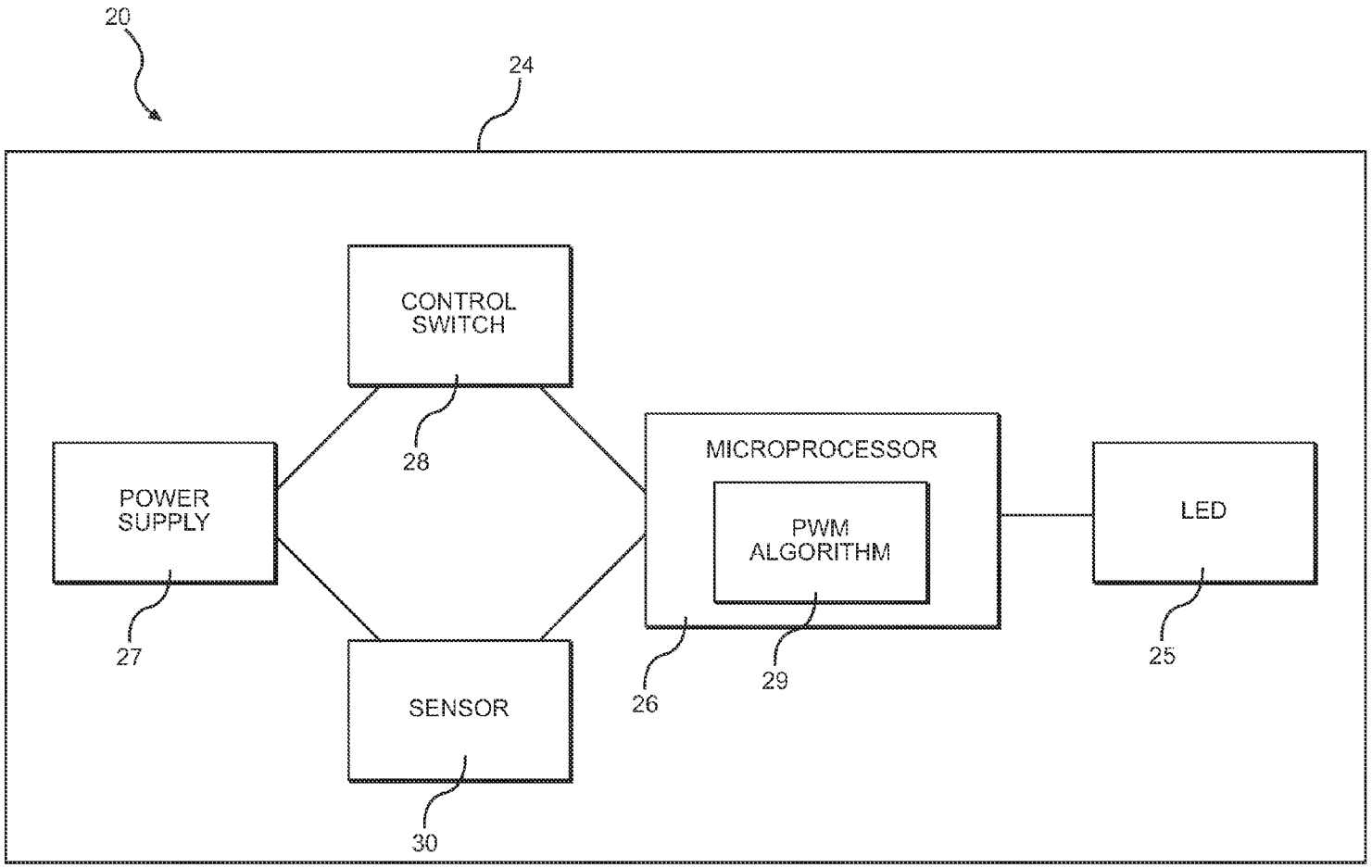
FIG. 3 shows a schematic diagram of the lighting assembly within the lighted backpack.

Referring now to FIG. 3, there is shown a schematic diagram of the lighting assembly 24 of the backpack 20. The lighting assembly 24 includes at least one LED 25 that employs at least three different color diodes in one casing; traditionally, these are red (R), green (G), and blue (B) (referenced later as different colored diodes). The different colored diodes can be combined in different proportions to produce thousands of resultant colors when viewed by the human eye. In some embodiments, the LED 25 includes fiber optic filaments attached thereto to allow the light illuminated from the LED 25 to travel through the filament and glow at the other end.

The lighting assembly 24 further comprises a microprocessor 26, a power supply 27 in addition to the at least one LED 25. In certain embodiments, the at least one LED 25 is formed into one or more arrays of LEDs 25, wherein each array that emits the same color have their cathode and anodes electrically tied together to form a channel. The channel is controlled by the microprocessor 26 independently of the other channels. It is possible that some arrays may have a higher or lower total number of LEDs 25 than others. It is also possible to have an array with only one LED 25 that forms a channel.

Preferably, the backpack 20 includes one microprocessor 26 to control the illumination and color of the LEDs 25, however, some embodiments may have multiple microprocessors 26 controlling multiple sets of LEDs and their respective arrays. In operation, the user selects the desired resultant light color (e.g., white, purple, green) for the desired LED 25 via a control switch 28. Preferably, the control switch 28 is a sliding switch or a touch wheel switch, however, as readily recognized by those of ordinary skill in the art, a variety of control switches 28 are appropriate, and these alterations and modifications are likewise contemplated. In addition, the control switch 28 is configured to activate and deactivate said lighting assembly 24. As illustrated in FIG. 2, the control switch 28 is placed on a bottom surface of the interior volume of the backpack, however it is likewise contemplated that other suitable locations of the control switch are likewise contemplated. After the user selects the desired resultant color, the control switch 28 relays the desired resultant color to the microprocessor 26.

The microprocessor 26 controls the relative intensity level of each LED 25 to achieve the desired resultant color. The intensity level of the LED 25 is controlled using a pulse-width modulation (PWM) algorithm 29 of a fixed current source provided by the power supply 27, preferably a battery. The microprocessor 26 is able to control the different colored diodes within the LED 25 by varying and modulating the current and relative intensity level to one another that flows through the different colored diodes that are encased within the LED 25. In the preferred embodiment, this is done by the PWM algorithm 29 within the microprocessor 26, which adjusts the PWM for each LED 25 to achieve the desired resultant color.

The PWM algorithm 29 allows linear control of the intensity level of the different colored diodes in the LEDs 25; that is, the intensity level of the different colored diodes in the LED 25 is directly proportional to the width of the pulse. The PWM algorithm 29 uses pre-stored calibration data to determine the PWM that should be applied to achieve the desired resultant color. By varying the PWM of the different colored diodes of the LED 25, it is possible to generate thousands of different resultant colors. Although a microprocessor 26 using a PWM algorithm 29 is disclosed, this does not imply that there are no other means of accomplishing voltage and current control. These means are readily apparent to those of ordinary skill within this art and are all deemed within the spirit and scope of the present invention.

The lighting assembly 24 further includes a motion sensor 30 that detects when the user is reaching within the interior volume of the backpack 20. Upon detection, the motion sensor 30 transmits a signal to the microprocessor 26 to activate the LEDs 25. The motion sensor 30 also detects when the user removes his hand from within the interior volume of the backpack 20, thereby deactivating the LEDs 25. The motion sensor 30 may rely on any means, including microwave energy, ultrasonic waves, or radio frequency signals, to detect the motion of a user reaching within the backpack 20, however, infrared means are preferred.

In the preferred embodiment, the motion sensor 30 is a passive infrared radiation detector (PIR). The motion sensor 30 is sensitive to changes in radiation from within a close range. The user within the range emits infrared radiation of sufficient magnitude to trigger the motion sensor 30 to provide an output signal. It is preferable, that the range of the motion sensor 30 is narrowly focused to avoid detecting extraneous movements. Too large of a range will unnecessarily activate the lighting assembly 24, while too small of a coverage area will not activate the lighting assembly 24 when required.

It is not desired at this time to limit the range that the motion sensor 30 detects, rather, it is desired to disclose and claim a functional motion sensor 30 for obtaining the results and advantages described herein. It is contemplated that this range of detection for the motion sensor 30 is readily discernible by those of ordinary skill within the art, and modifications and variations envisioned by those of ordinary skill within the art are deemed to be within the scope of invention embodiments described herein.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above descriptions then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lighted backpack, comprising:

a housing forming an interior volume therein;

wherein an opening of said housing provides access to said interior volume;

a lighting assembly disposed within said interior volume, wherein said lighting assembly is configured to provide illumination within said interior volume;

said lighting assembly comprising a power supply, a control switch, a microprocessor, and at least one light emitting diode.

2. The lighted backpack of claim 1, wherein:

said at least one light emitting diode includes at least three different colored diodes encased in a single casing;

wherein said different colored diodes include red, green, and blue colored diodes;

wherein said different colored diodes are adapted to be modulated in relative intensity to one another to achieve a multitude of colors by said microprocessor.

3. The lighted backpack of claim 1, wherein:

said control switch is electrically connected to said power supply and said microprocessor;

wherein said control switch is configured to allow a user to choose a desired resultant color selected among a plurality of colors, which is then relayed to said microprocessor.

4. The lighted backpack of claim 1, wherein said microprocessor is electrically connected to said at least one light emitting diode and is configured to control said at least one light emitting diode to achieve said desired resultant color.

5. The lighted backpack of claim 2, wherein said microprocessor includes a pulse-width modulation algorithm configured to vary and modulate relative intensity of said different colored diodes of said at least one light emitting diode to achieve said desired resultant color.

6. The lighted backpack of claim 1, wherein:

a motion sensor is electrically connected to said power supply and is configured to detect when a user is reaching within said interior volume of said housing;

wherein said motion sensor is configured to transmit a signal to said microprocessor to activate said lighting assembly when motion is detected.

7. The lighted backpack of claim 6, wherein said motion sensor is a passive infrared sensor.

8. The lighted backpack of claim 1, wherein said at least one light emitting diode includes a plurality of fiber optic filaments attached thereto.

* * * * *